US012584364B2

(12) United States Patent
Morrison et al.

(10) Patent No.: US 12,584,364 B2
(45) Date of Patent: Mar. 24, 2026

(54) ELECTRIC IGNITER FOR DOWNHOLE SETTINGS TOOLS

(71) Applicant: DBK Industries, LLC, Crowley, TX (US)

(72) Inventors: Jeremy Todd Morrison, Pickton, TX (US); Nicholas Clayton Fearka, Mansfield, TX (US)

(73) Assignee: DBK INDUSTRIES, LLC, Crowley, TX (US)

( * ) Notice: Subject to any disclaimer, the term of this patent is extended or adjusted under 35 U.S.C. 154(b) by 82 days.

(21) Appl. No.: 18/391,642

(22) Filed: Dec. 20, 2023

(65) Prior Publication Data

US 2024/0218755 A1 Jul. 4, 2024

Related U.S. Application Data

(60) Provisional application No. 63/469,030, filed on May 25, 2023, provisional application No. 63/435,796, filed on Dec. 28, 2022.

(51) Int. Cl.
*E21B 23/04* (2006.01)
*E21B 36/04* (2006.01)

(52) U.S. Cl.
CPC ..... *E21B 23/0414* (2020.05); *E21B 36/04* (2013.01)

(58) Field of Classification Search
CPC ..... E21B 23/0414; E21B 36/04; F42D 1/06; F42D 1/055; F42D 1/05; F42D 1/045; F42D 1/043; F42D 1/042; F42D 1/041; F42D 1/04
USPC ..... 102/200
See application file for complete search history.

(56) References Cited

U.S. PATENT DOCUMENTS

| | | | | |
|---|---|---|---|---|
| 6,289,813 | B1 * | 9/2001 | Duguet | F42B 3/124 102/202.7 |
| 6,591,754 | B1 * | 7/2003 | Baur | H01R 13/665 102/206 |
| 9,598,942 | B2 * | 3/2017 | Wells | E21B 43/1185 |
| 10,472,939 | B2 | 11/2019 | Sullivan | |
| 11,053,783 | B2 | 7/2021 | Montoya Ashton et al. | |
| 12,392,216 | B2 * | 8/2025 | Zakharia | E21B 33/13 |
| 2015/0345922 | A1 * | 12/2015 | Lanclos | F42B 3/125 102/335 |

FOREIGN PATENT DOCUMENTS

| | | | | |
|---|---|---|---|---|
| DE | 4218881 | A1 * | 1/1993 | F42C 15/31 |

* cited by examiner

*Primary Examiner* — John Cooper
(74) *Attorney, Agent, or Firm* — Johnston IP Law, PLLC

(57) ABSTRACT

Igniter assemblies for use with setting tools are disclosed. The igniter assemblies have an electronic heating element disposed adjacent to an energetic material within a setting tool. In some embodiments, the electronic heating element is a resistor or a PCB mounted resistor. Electrical connections are attached to the heating element to provide electrical current to activate the heating element. In some instances, the electrical heating element is disposed onto an insulator cap that is coupled to a pressure block attached to the setting tool, and in some instances the electronic heating element is attached to a non-explosive portion and the energetic material is disposed within an explosive portion. When the non-explosive portion and the explosive portion are assembled, the electronic heating element is adjacent to the energetic material. Other assemblies are described.

10 Claims, 12 Drawing Sheets

ELECTRIC IGNITER FOR DOWNHOLE SETTINGS TOOLS

CROSS-REFERENCE TO RELATED APPLICATION

This application claims the benefit of U.S. Provisional Patent Application Ser. No. 63/469,030 filed on May 25, 2023 entitled "Electric Igniter for Downhole Setting Tools," and to U.S. Provisional Patent Application Ser. No. 63/435,796 filed on Dec. 28, 2022, entitled "Igniterless Igniters," both of which are incorporated herein by reference in their entirety for all purposes.

TECHNICAL FIELD

This application is directed, in general, to the recovery of hydrocarbons from the ground, and more particularly, to electric igniters for downhole setting tools.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Oil and gas wells are drilled into earth formations by first creating a borehole and then running and cementing casing in the borehole. Well tools such as bridge plugs, packers, cement retainers, and frac plugs are often run into cased wells and set using setting tools powered by flammable power charges. Conventional well tools providing well casing sealing assemblies typically include a packer having one or more elastomeric sealing elements that are squeezed between a packer mandrel and the casing. They are held in place by one or more slip assemblies that are wedged between conical sleeves of the packers and the casing. The packers are configured for use as bridge plugs, tubing packers, cement retainers, and frac plugs.

Various downhole components are often activated by the rapid expansion of gasses caused by ignition of an explosive charge. An igniter is used to initiate the ignition of the explosive charge. Improvements in the technology remain desirable.

SUMMARY

According to an illustrative embodiment, an igniter assembly for use with a setting tool includes a pressure block having a first end, a second end, and an interior portion; a pressure bulkhead sized and configured to couple to a portion of the pressure block in the interior portion of the pressure block; an insulator cap sized and configured to couple to the second end of the pressure block; a power charge within a combustion chamber adjacent to the pressure block and having a first end and a second end; and a power transfer conductor. The first end of the power charge abuts the insulator cap, and the power charge has an energetic material at the first end and a main propellant adjacent thereto. The insulator cap further includes an insulator cap body having an exterior surface and an electrical heating element positioned on the exterior surface of the insulator cap and disposed adjacent to the energetic material of the power charge when in an assembled position. In some embodiments, the insulator cap also includes a tension spring coupled to the insulator cap body that biases the electrical heating element toward the energetic material when in the assembled position. The electrical heating element has a first lead and a second lead and a power transfer conductor is electrically coupled to the first or second lead of the electrical heating element. In some embodiments, a conduction plate is coupled to the insulator cap body for receiving electrical energy through the power transfer conductor that abuts the conduction plate or is coupled to the conduction plate in an assembled position.

According to an illustrative embodiment, an igniter assembly for use with a setting tool includes a pressure block having a first end, a second end, and an interior portion; a pressure bulkhead sized and configured to secure to a portion of the pressure block in the interior portion of the pressure block; an insulator cap sized and configured to couple to the second end of the pressure block; a power charge within a container within a combustion chamber adjacent to the pressure block and having a first end and a second end; a power charge end cap having a first side and second side, with the second side of the power charge end cap attached to the first end of the container of the power charge and the first side of the power charge end cap disposed adjacent to the pressure block when in an assembled position; an electrical heating element disposed in an interior of the container of the power charge adjacent to the energetic material; and a power transfer conductor electrically coupled to the insulator cap contact. The first end of the power charge abuts the insulator cap, and the power charge has an energetic material at the first end and a main propellant adjacent to the energetic material, The container has a first end and a second end. The electrical heating element has a first lead and a second lead. The power charge end cap has a power charge end cap contact and the insulator cap has an insulator cap contact. When in an assembled position the power charge end cap contact is electrically coupled to the insulator cap contact and the first lead of the electrical heating element is electrically coupled to the power charge end cap contact. The insulator cap includes an insulator cap body and the insulator cap contact. The insulator cap contact is biased outward toward the power charge end cap and sized and configured to contact the power charge end cap contact when in an assembled position.

According to an illustrative embodiment, an igniter assembly for use as an aspect of a setting tool includes a non-explosive portion having a printed circuit board with an electrical heating element coupled thereto and an explosive portion having an energetic material and a power charge material. The explosive portion is formed with a slot sized and configured to receive at least a portion of the printed circuit board. When in an assembled position the explosive portion is coupled to the non-explosive portion with the printed circuit board at least partially within the slot and with the electrical heating element adjacent to the energetic material in the explosive portion. Other devices, systems, and methods are disclosed herein.

DESCRIPTION OF THE DRAWINGS

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Unless otherwise indicated, as used throughout this document, "or" does not require mutual exclusivity. As used herein, "a" refers to at least one.

Figure 1:
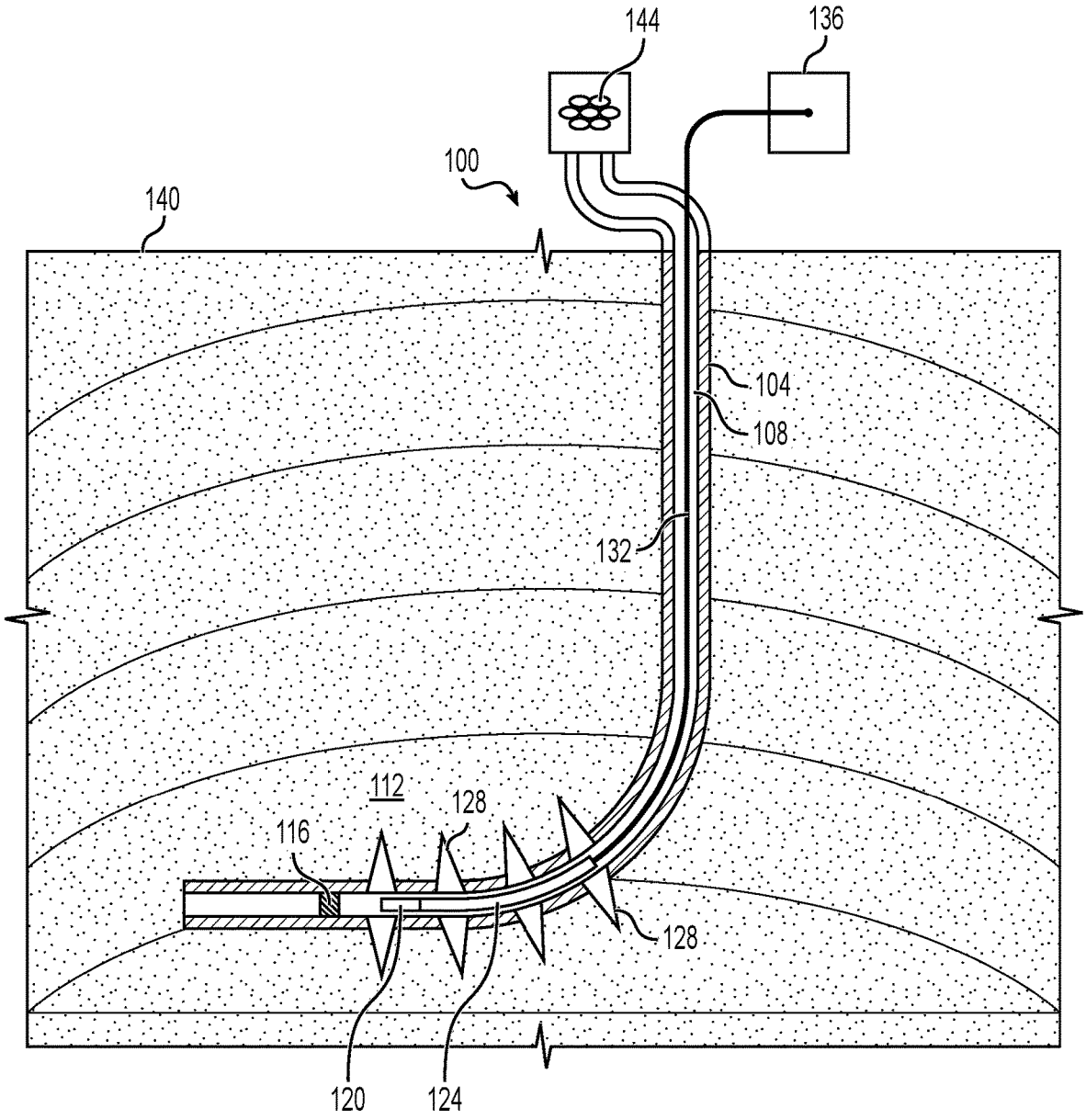
FIG. 1 is schematic, diagram of a well undergoing an aspect of well completion according to an illustrative embodiment.
Figure 2:
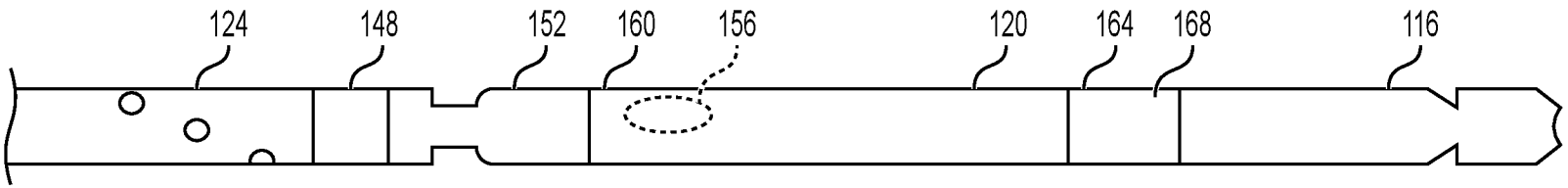
FIG. 2 is a schematic, diagram of a perforating gun assembly and setting tool according to an illustrative embodiment.

Reference is made to the figures and initially to FIGS. 1 and 2. In efforts to recover hydrocarbons from the ground, wells 100 are drilled to the desired depth and then must be completed to make the well ready for production. An aspect of this involves applying casing 104 to protect the wellbore 108. The casing 104 is cemented in place and then steps are taken to connect to the desired subterranean formation 112 to extract the hydrocarbons. This may involves plugging the well 100 with a plug 116 delivered by a setting tool 120 and then perforating the casing 104 with a perforating gun assembly 124. The perforation process produces channels 128. In this illustration, the setting tool 120 has been disconnected from the plug 116.

The setting tool 120 is powered in this instance by gases generated in situ. A power charge is initiated that creates the high-pressure gases that are used to move parts relative to one another and cause the setting tool 120 to perform the desired work, such as setting plug 116 in position in the wellbore. Flames from the igniter ignite the power charge located in a combustion chamber in the setting tool which causes one or more pistons to move, and that movement actuates one part of the plug or other aspects of the setting tool 120.

A wireline 132 may be used to control the perforation gun assembly 124 and the setting tool 120. The wire line 132 may be electrically coupled to a control interface 136 at the surface 140 and allow an operator to control the sending of electrical signals to the perforating gun assembly 124 or the setting tool 120. In the case of activation of an igniter assembly (see e.g. FIGS. 3, 5,10, 11), an electrical current is sent through wire line 132 and possibly various downhole components that, on a downhole string, are uphole relative to the igniter assembly. The electrical current activates the igniter assembly which in turn activates an explosive or flammable charge to provide gases to activate components.

Also shown symbolically, a fluid 144 (FIG. 1), such as water and sand or fracturing fluid, maybe pumped down the well for moving the perforating gun assembly 124 and the setting tool 120 to a desired depth to perform the referenced operations or for other purposes. The operations may be repeated as many times as necessary to prepare the well to produce hydrocarbons.

Referring now primarily to FIG. 2, an illustrative embodiment of the perforating gun assembly 124 and setting tool 120 is presented. Those skilled in the art will appreciate that many different arrangements may be used. In this embodiment, the perforating gun assembly 124 is coupled to an adapter 148, which is coupled to a quick change 152. The quick change 152 is coupled to the setting tool 120, which includes an igniter assembly 156 (hidden lines). The setting tool 120 has a first end 160 and a second end 164. The second end 164 is coupled to a running gear adapter 168, which is coupled to the plug 116.

Referring now primarily to FIGS. 3-14, to power downhole gas-operated tools of various kinds, the high-pressure gases must be developed. This is done with power charges. In the embodiments shown herein, an igniter is provided that does not require an incendiary charge in the igniter. An electrical heating element is used to activate the power charge. Because the bulkhead igniter does not have a charge for ignition, it may be thought of as an "igniterless igniter" and may be transported in regular cargo.

Figure 3:
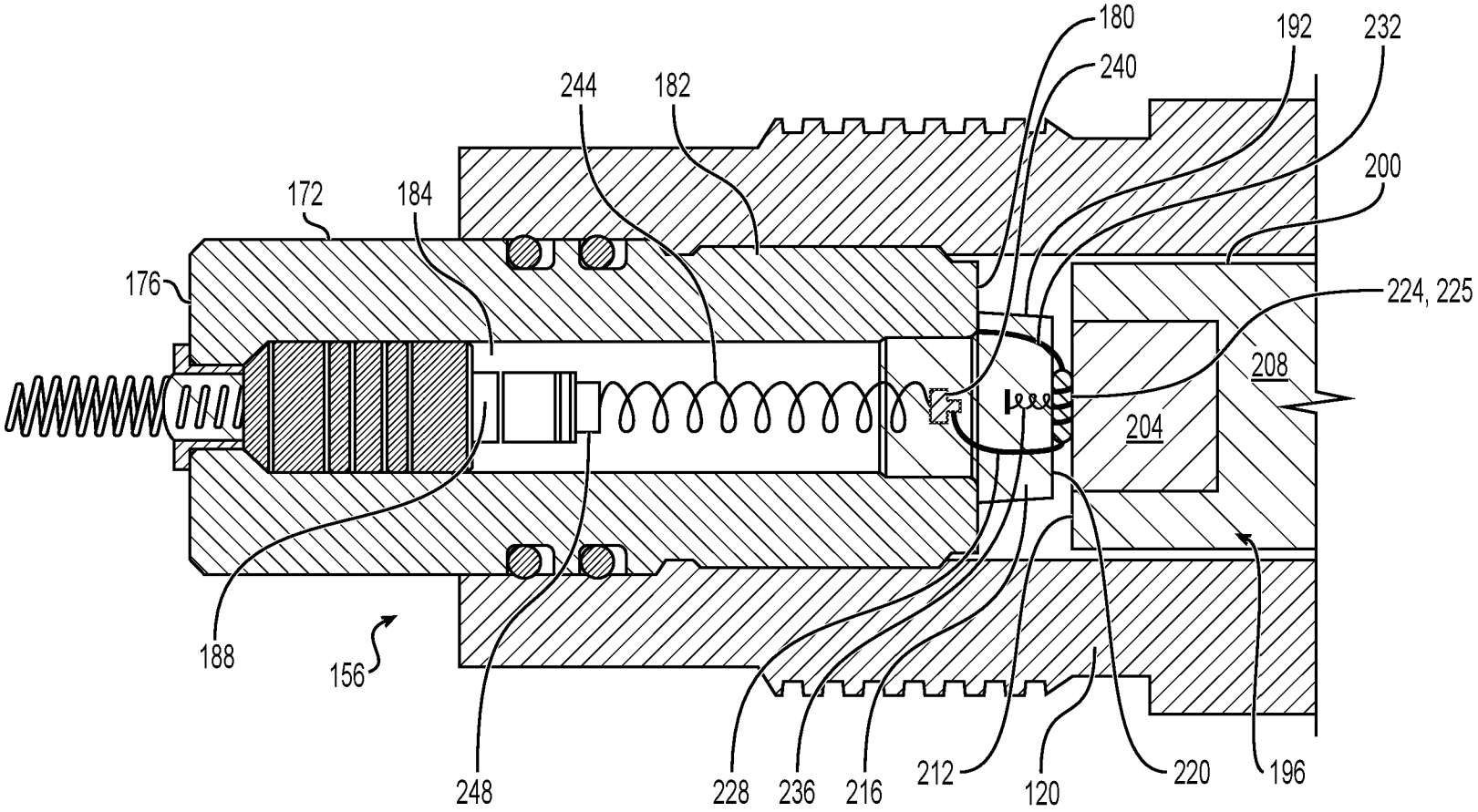
FIG. 3 is a schematic, cross section of an igniter assembly according to an illustrative embodiment.

Referring now primarily to FIG. 3, a portion of the setting tool 120 is presented with the igniter assembly 156 coupled thereto. The igniter assembly 156 includes a pressure block 172 having a first end 176, second end 180, and an interior 184. The pressure block 172 is releasably coupled to a portion of the setting tool 120, such as by threaded connection 182. The igniter assembly 156 further includes a pressure bulkhead 188. An insulator cap 192 is sized and configured to couple to the second end 180 of the pressure block 172.

Figure 4:
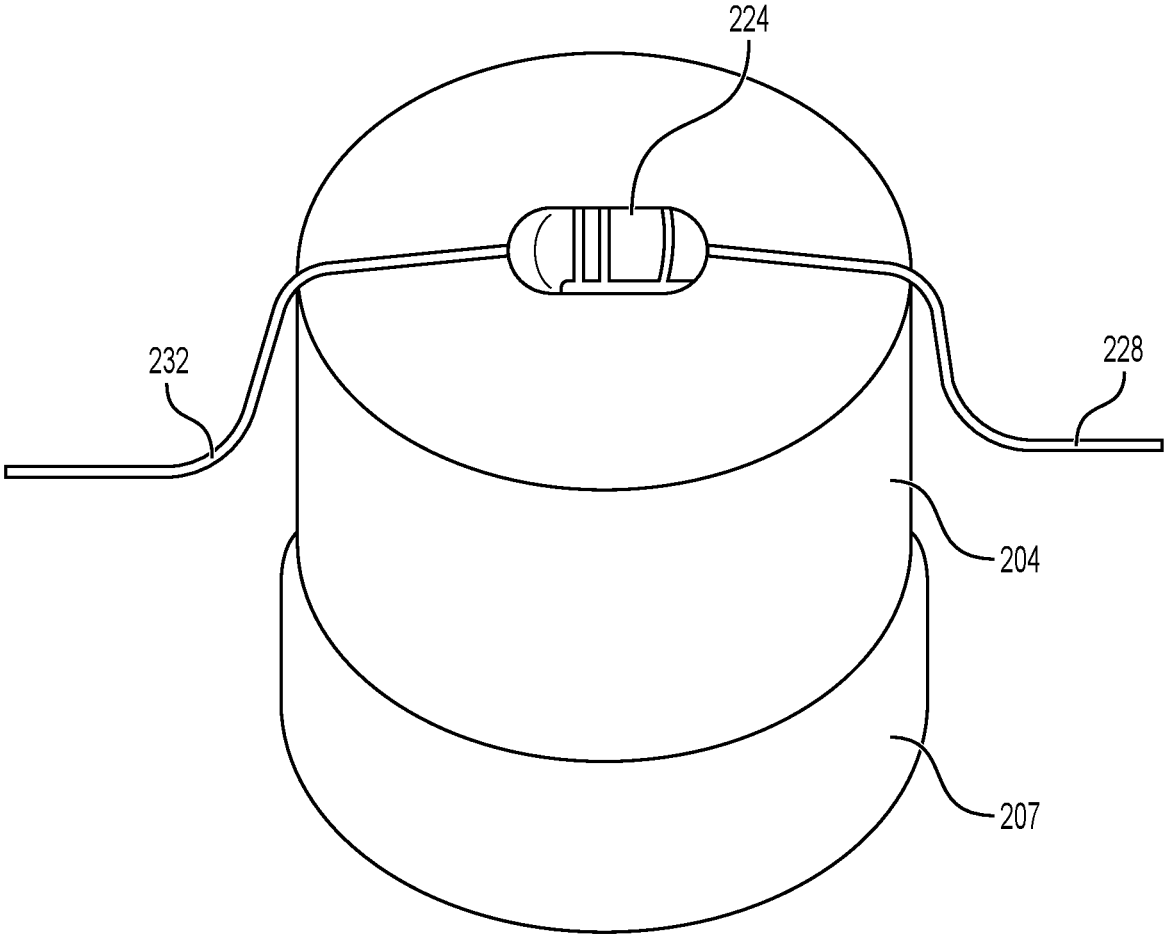
FIG. 4 is a schematic, perspective view of an electrical heating element on an energetic material according to an illustrative embodiment.

The igniter assembly 156 further includes a power charge 196, which includes a container 200. The power charge 196 has an energetic material 204 (or initiation material or igniter or secondary pellet) and a main propellant 208 adjacent to the energetic material 204. The main propellant 208 and the energetic material 204 may be a mixture of combustible components, and oxidizer, and an epoxy binder. The propellant 208 and the energetic material 204 are compounds or mixtures of compounds that are flammable or explosive and that, upon ignition, burn and release gases. The energetic material 204 is typically formulated to have a lower ignition temperature or activation energy than the main propellant 208. Often the energetic material 204 is the initial material to ignite and the energy released from the ignition of the energetic material causes the ignition of the main propellant 208. Other compositions may be used for energetic material 204. The energetic material 204 may be formed with an annular shaped protrusion on one end for retaining it within the main propellant 208. (FIG. 4). In some embodiments, the energetic material 204 is omitted and only the main propellant 208 is used.

The energetic material 204 is disposed proximate to a first end 212 of the power charge 196. The power charge 196 is disposed adjacent to the pressure block 172 and has the first end 212 and a second end (not explicitly shown) at the opposite end. The first end 212 of the power charge 196 abuts the insulator cap 192.

The insulator cap 192 includes an insulator cap body 216 having an exterior surface 220. The insulator cap 192 also has an electrical heating element 224 positioned on the exterior surface 220 of the insulator cap 192 and disposed adjacent to the energetic material 204 of the power charge 196 when in an assembled position as shown. The electrical heating element 224, has a first lead 228 and a second lead 232. The electrical heating element 224 may be any device that generates sufficient heat to ignite the energetic material 204 when electrical current is applied to the electrical heating element 224. In some embodiments, the electrical heating element 224 is a resistor 225. In some embodiments heat is generated by applying sufficient electrical current to the resistor 225 to cause the resistor 225 to emit heat. In some embodiments, the amount of electrical current applied to the resistor 225 is sufficient to cause the resistor to flash or to catch on fire. In other embodiments, the electrical heating element 224 may be a different device capable of generating heat in response to an electrical current, such as a heating element or heating coil. In some embodiments the electrical heating element 224 is a nickel-chromium alloy wire. A tension spring 236 is coupled to the insulator cap body 216 and biases the electrical heating element 224 toward the energetic material 204 when in the assembled position.

The insulator cap 192 further includes a conduction plate 240 coupled to the insulator cap body 216, such as by screws, for receiving electrical energy through a power transfer conductor 244 that abuts the conduction plate 240 or is coupled to the conduction plate 240 in an assembled position. The conduction plate 240 is electrically coupled to the first lead 228 of the electrical heating element 224. In alternative embodiments, the conduction plate 240 may be omitted and the power transfer conductor 244 may be directly connected to the first lead 228. The power transfer conductor 244 may be any conductor capable of conducting electricity. In some embodiments the power transfer conductor 244 is a spring, coil, wire, rod, or block. In some embodiments, the power transfer conductor 244 is a transfer spring (as shown). A bridge bolt 248 is coupled to the pressure bulkhead 188. The bridge bolt 248 may screw into or otherwise couple to the pressure bulkhead 188. The power transfer conductor 244 is attached to the bridge bolt to provide an electrical current pathway. Electricity is carried through the bridge bolt 248 to the power transfer conductor 244, to the conduction plate 240, to the first lead 228, and to electrical heating element 224. The second lead 232 carries the electrical path back to ground or chassis by making contact with the pressure block 172 or other appropriate grounding contact with other electrical conducting components of the downhole string.

When activation of the power charge 196 is desired, an electrical current is sent that is delivered through the bridge bolt 248, transfer spring 244, conduction plate 240 and first lead 228 to the electrical heating element 224. The electricity heats the electrical heating element 224 sufficiently to cause ignition of the energetic material 204, which, in turn, ignites the main propellant 208. The electrical heating element 224 may flash when provided with sufficient power. Ignition of the main propellant 208 causes the generation and rapid expansion of gasses. The resultant gases power the setting tool 120.

Referring now primarily to FIG. 4, an illustrative diagram of an electrical heating element 224 on the energetic material 204 is shown. Good contact is desired between the electrical heating element 224 and the energetic material 204. Good contact between the electrical heating element 224 and the energetic material 204 increases the heat transfer from electrical heating element 224 to the energetic material 204 and increases the likelihood of successful ignition of the energetic material 204. Good contact may be when the components touch, touch with force. Contact between the electrical heating element 224 and the energetic material 204 is not always required, so long as the components are close enough together for the electrical heating element 224 to transfer sufficient energy to the energetic material 204 to ignite the energetic material 204. In this embodiment, the energetic material is formed with a ridge 207 on the end of the energetic material 204 that is embedded into the main propellant 208 (see FIG. 5). This results in the energetic material 204 being securely contained by the main propellant 208 and further insures good contact between the energetic material 204 and the main propellant 208.

Figure 5:
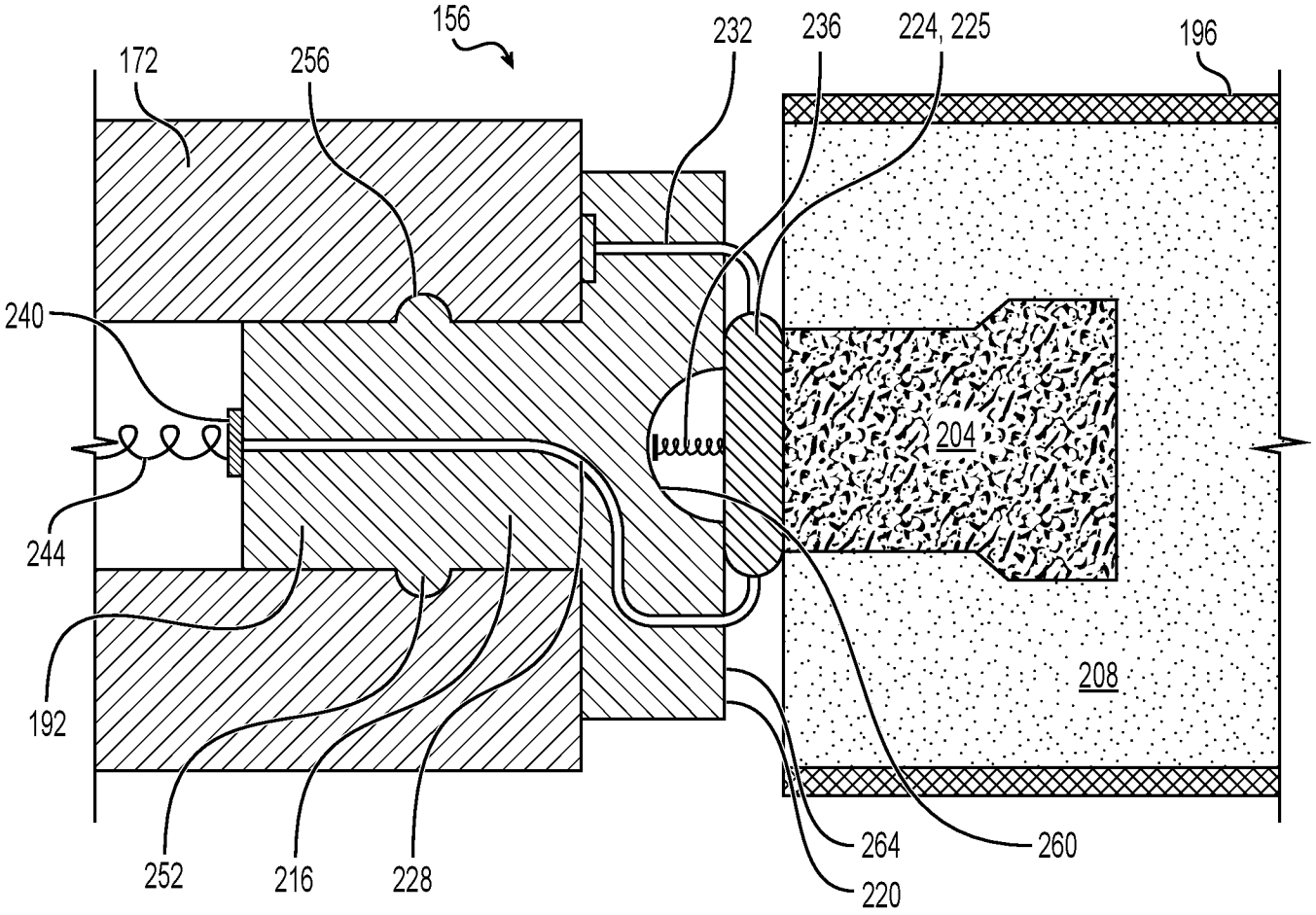
FIG. 5 is a schematic, cross section of a portion of an igniter assembly according to an illustrative embodiment.

Referring now primarily to FIG. 5, a cross section of a portion of an igniter assembly 156 is presented. This embodiment is analogous to that shown in FIG. 3 in most respects. In this embodiment, one may see that the insulator cap 192 is formed with ridges 252 that go into complementary notches 256 on the pressure block 172 to form a snap-on connection of the insulator cap 192 to the pressure block 172. In some embodiments, this is reversed so that the insulator cap 192 has a notch and the pressure block 172 has a ridge. The snap-on insulator cap 192 may be formed from any material that has sufficient flexibility to deform as it is pressed into the pressure block 172 and that will reform once a ridge/notch connection is achieved. The ridges 252 and the notches 256 are of sufficient shape and size to hold the insulator cap 192 in place once the insulator cap 192 has been snapped or pressed onto the pressure block 172. The tension spring 236 is shown in a recess 260 formed on an outward face 264. The tension spring 236 urges or biases the electrical heating element 224 towards the energetic material 204. Urging or biasing the electrical heating element 224 towards the energetic material 204, improves heat transfer from the electrical heating element 224 to the energetic material 204, which improves the ignition results of the energetic material 204.

Like the embodiment of FIG. 3, the illustrative embodiment of FIG. 5 is activated by sending electrical current to the electrical heating element 224. Electrical current is applied to the transfer spring 244, which flows through the conduction plate 240, the first lead 228, and to the electrical heating element 224. The modifications and alternative embodiments described in relation to the illustrative embodiment of FIG. 3 are equally applicable to the illustrative embodiment of FIG. 5.

Figure 6:
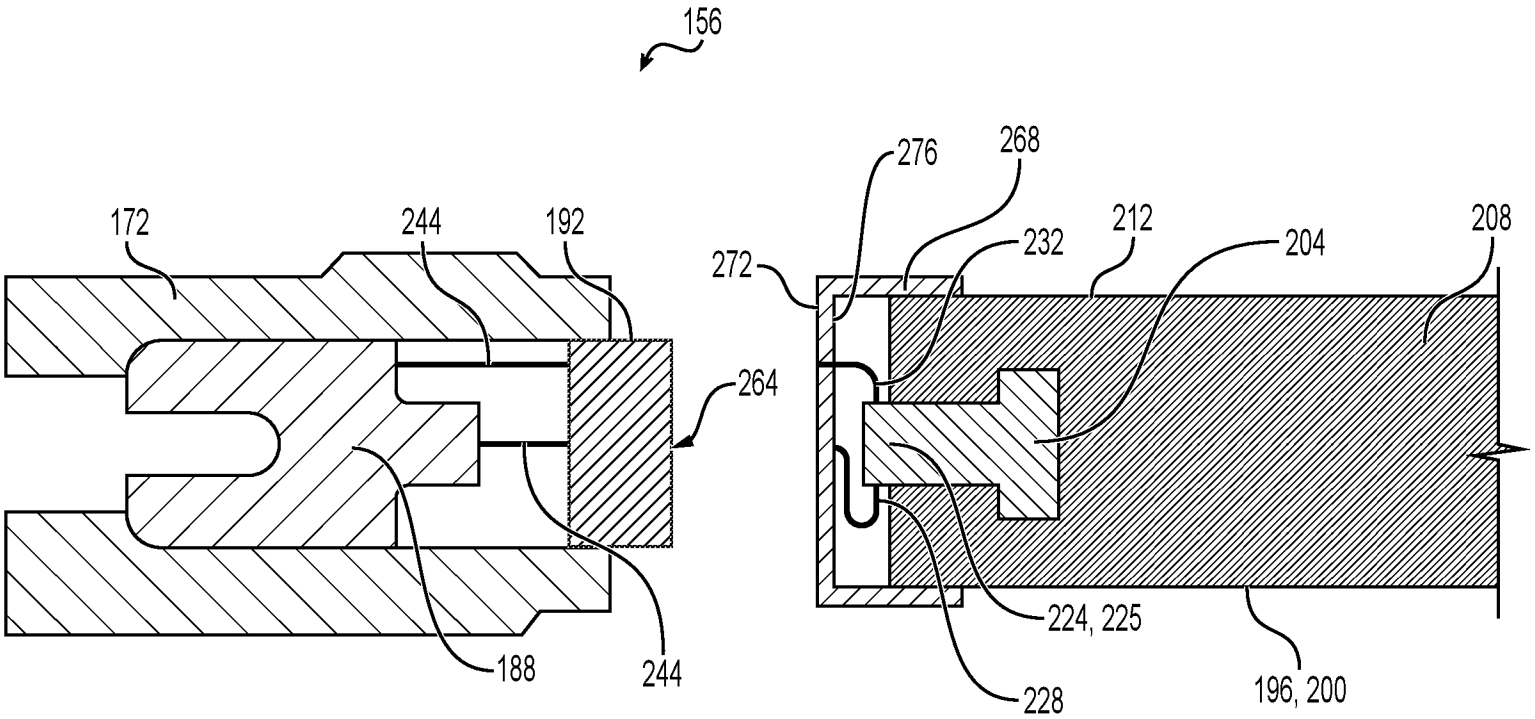
FIG. 6 is a schematic, cross section of a portion of an igniter assembly according to an illustrative embodiment.

Referring now primarily to FIG. 6, another illustrative embodiment of an igniter assembly 156 is schematically shown. In this embodiment, the power charge 196 has a container 200 with a power charge end cap 268 on a first end 212 of the power charge 196. The energetic material 204 and the main propellant 208 are packed within the container 200. The power charge end cap 268 is fitted over the first end 212 of the power charge 196. The power charge end cap 268 has a first side 272 and a second side 276. In this embodiment, the electrical heating element 224 is positioned between the second side 276 and the energetic material 204, so that the electrical heating element 224 is sandwiched between the second side 276 of the power charge end cap 268 and the energetic material 204. The leads 228, 232 are electrically coupled to the pressure bulkhead 188, although, in some embodiments, one lead may be grounded elsewhere. Like in the previous embodiments, the electrical connection between the pressure bulkhead 188 and the leads 228, 232 may be made with a power transfer conductor 244, such as a wire, coil, spring, or block capable of conducting electricity.

Figure 8:
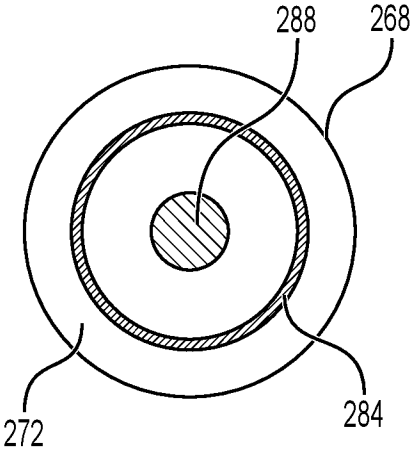
FIG. 8 is a schematic, plan view of a first side of a power charge end cap according to an illustrative embodiment.
Figure 7:
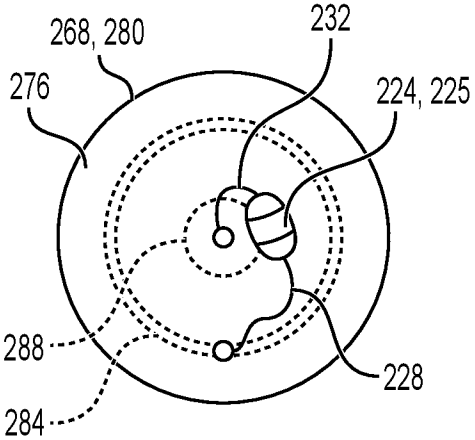
FIG. 7 is a schematic, plan view of a second side of a power charge end cap according to an illustrative embodiment.

Referring now primarily to FIGS. 7 and 8, the second side 276 of the power charge end cap 268 is shown in FIG. 7 and the first side 272 of the power charge end cap 268 is shown in FIG. 8. The electrical heating element 224 is shown with leads 228 and 232 going through the power charge end cap body 280. The power charge end cap 268 has a first electrical interface forming a first power charge end cap contact 284 on the first side 272 of the power charge end cap 268. The first lead 228 of the electrical heating element 224 is electrically coupled to the first power charge end cap contact 284. Likewise, the power charge end cap 268 has a second electrical interface forming a second power charge end cap contact 288 on the first side 272 of the power charge end cap 268. The second lead 232 of the electrical heating element 224 is electrically coupled to the second power charge end cap contact 288.

Referring now primarily to FIG. 8, the first side 272 of the power charge end cap 268 is shown. In this illustrative embodiment, the first power charge end cap contact 284 is a conductive ring and the second power charge end cap contact 288 is a centered contact pad.

Figure 9:
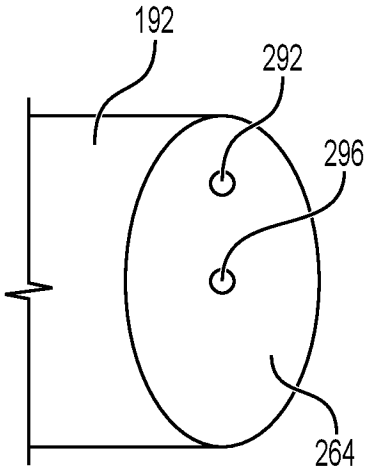
FIG. 9 is a schematic, perspective view of a second end of an insulator cap according to an illustrative embodiment.

As shown in FIG. 9, the outward face 264 of the insulator cap 192 has a first insulator cap contact 292 that is sized and configured to touch or electrically couple to the first power charge end cap contact 284 when the insulator 192 is placed against the first side 272 of the power charge end cap 268. Likewise, the insulator cap 192 has a second insulator cap contact 296 that is sized and configured to touch or electrically couple to the second power charge end cap contact 288 when the insulator 192 is placed against the first side 272 of the power charge end cap 268. When installed within the igniter assembly 156, the outward face 264 of the insulator cap 192 abuts the first side 272 of the power charge end cap 268 and are aligned so that the first power charge end cap contact 284 of the power charge end cap 268 makes electrical contact with the first insulator cap contact 292 of the insulator cap 192 and the second power charge end cap contact 288 of the power charge end cap 268 makes electrical contact with the second insulator cap contact 296 of the insulator cap 192. Therefore, when assembled, the electrical circuit between the power transfer conductor 244 and the electrical heating element 224 is completed. In this way, the heating element 224 may be contained within the power charge 196 and yet quick, reliable electrical connections may be established.

Figure 10:
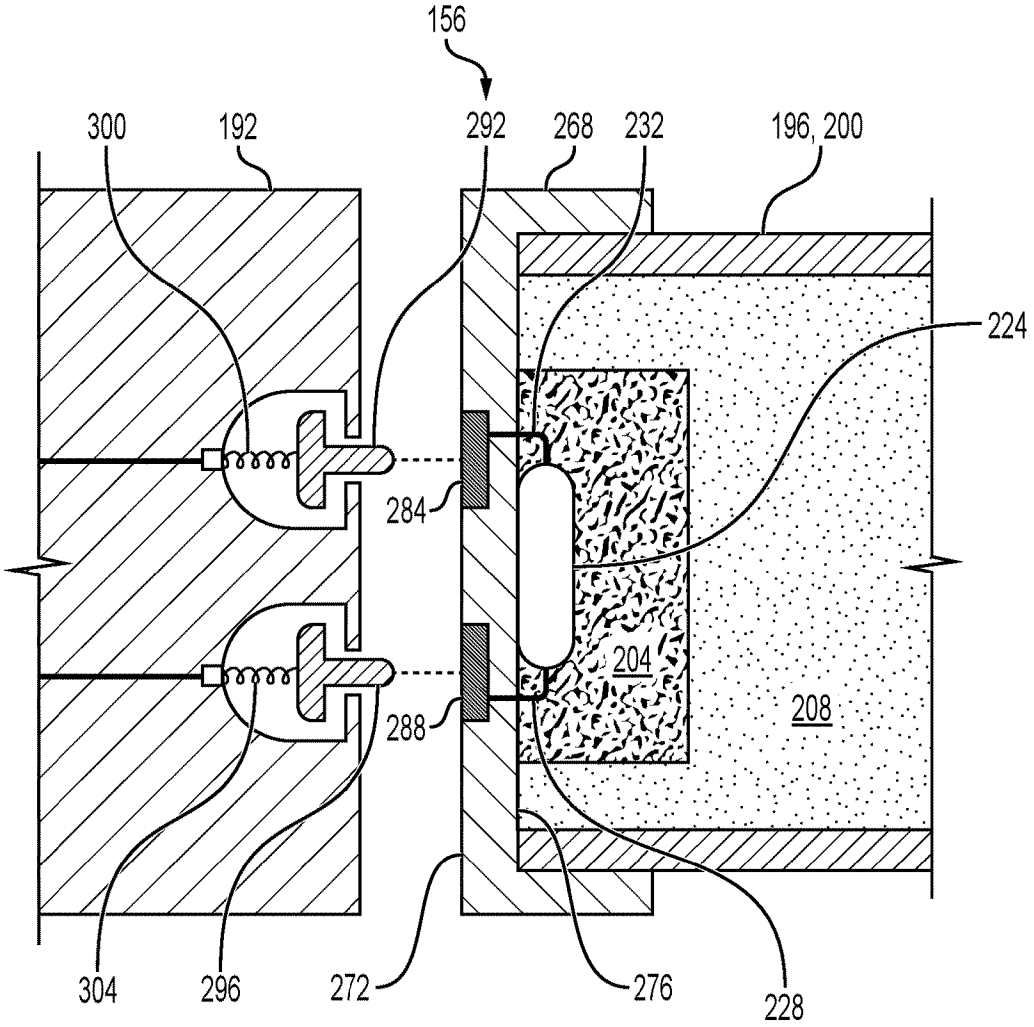
FIG. 10 is a schematic, partially exploded cross-sectional view of a portion of an igniter assembly according to an illustrative embodiment.

Referring now primarily to FIG. 10, an illustrative, partially exploded cross sectional view of a portion of igniter assembly 156 is presented that is analogous in most respects to that shown in FIGS. 6-9. The first electrical contact 292 of the insulator cap 192 is urged outwardly by a first conductive tension spring 300. The second electrical contact 296 of the insulator cap 192 is urged outwardly by a second conductive tension spring 304. The first electrical contact 292 is sized and configured to contact the electrical contact 284 of the power charge end cap 272. The second electrical contact 296 is sized and configured to contact the electrical contact 288 of the power charge end cap 272. The bridge bolt 248 (FIG. 3) may be electrically coupled to the second electrical contact 296 and the first electrical contact 292 may be electrically coupled to a ground.

The illustrative embodiments of the power charge end cap 268 or the insulator cap 192 may be made from a non-conductive plastic or polymer material with a melting point higher than typical downhole temperatures. In some embodiments, the power charge end cap 268 or the insulator cap 192 is made from a polymer or plastic that has a melting point greater than 250 degrees Fahrenheit. In some embodiments, the power charge end cap 268 or the insulator cap 192 is made from a polymer or plastic that has a melting point greater than 400 degrees Fahrenheit. In some embodiments, the power charge end cap 268 or the insulator cap 192 is made from a nylon, Teflon, or Delrin material.

In one illustrative embodiment, when current is applied through the pressure bulkhead 188, the current passes through the bridge bolt 248 and power transfer conductor 244, through the second electrical contact 296 of the insulator cap 192, through the second electrical contact 288 of the power charge end cap 268 and to the electrical heating element 224, which is grounded to complete the electrical circuit. When sufficient electrical current is applied, the electrical heating element 224 heats up, catches on fire, or flashes, which ignites the energetic material 204 of the power charge 196.

Because the pressure bulkhead 188, or bulkhead igniter 156, shown herein does not have any aspects of the power charge in it, i.e., they do not contain any incendiary or explosive materials, such illustrative embodiments present an advantage in that they may be shipped without the requirements of shipping hazardous materials. Other advantages may exist.

The previous embodiments herein used primarily an electrical heating element 224, such as a through-hole resistor, for ignition of the ignition material, or energetic material 204. In contrast, with reference primarily to FIGS. 11-14, an igniter assembly 400 is presented that includes a printed circuit board ("PCB") mounted heating element or source 408, which in some embodiments is a PCB mounted resistor 404, to ignite the energetic material 204. The igniter assembly 400 is shown for use in a setting tool, e.g., setting tool 120 (FIG. 3), but for clarity and convenience is shown without the mandrel and other aspects of the setting tool 120.

The igniter assembly 400 is at least a two-part igniter assembly having a non-explosive portion 402 and an explosive portion 403. The components of the non-explosive portion 402 do not include any explosive or incendiary components. The explosive or incendiary components, which are the power charge 480 and the energetic material 424, are contained within the explosive portion 403 of the igniter assembly 400. The energetic material 424 is analogous to the energetic material 204 of the illustrative embodiments of FIGS. 2-10. This arrangement provides the benefit of being able to handle (e.g., manufacture, assembly, transfer, etc.) the non-explosive portion 402 without having to adhere to standards for handling explosive materials. It also provides the benefit of being able to keep the explosive materials separated from the ignition component until the igniter assembly 400 is assembled for use, which can prevent premature detonation of the explosive material.

The electrical heating element or source 408 is part of the non-explosive portion 402 and is mounted on a PCB 412, which is mounted within cartridge 448. The energetic material 424 is contained within a power cartridge 416, which is located in the explosive portion 403. The non-explosive portion 402 and the explosive portion 403 are designed to mate and fit together to form the completed igniter assembly 400. When the non-explosive portion 402 and the explosive portion 403 are fitted together, the PCB 412, which has a proximate end 461 located within a cartridge cavity 453 of the cartridge 448 and a distal end 463 extending from a downstream wall or end plate 468 of the cartridge 448, extends from the cartridge 448 toward the explosive portion 403 and is inserted into the explosive portion 403 so that the electrical heating element 408, such as resistor 404, is adjacent to the energetic material 424. In some embodiments, the explosive portion 403 has a slot 420 sized and configured to receive at least a portion of the PCB 412, e.g. receive the distal end 463.

The non-explosive portion 402 includes a pressure block 436 having a first end 481, a second end 449, and an interior portion 485. The cartridge 448 contains a pressure bulkhead 432, which extends in an upstream direction (left for the orientation shown) out of the cartridge 448. The pressure bulkhead 432 and cartridge 448 are sized and configured to couple to a portion of the pressure block 436 in the interior portion 485 of the pressure block 436. The cartridge 448 and the pressure bulkhead 432 are coupled to each other at an upstream end of the cartridge 448. The cartridge 448 has the downstream wall 468 located adjacent to the explosive portion 403 when ignitor assembly 400 is assembled. The PCB 412 is partially disposed within a cartridge cavity 453 of the cartridge 448 and is partially disposed outside of the cartridge 448 proximate the downstream wall 468, so that the downstream end of the PCB 412 extends in a downstream direction beyond the cartridge wall 468.

The explosive portion 403, in some embodiments, includes a power cartridge body 488 having an interior chamber housing the energetic material 424 and a slot 420. The slot 420 is used to introduce the portion of the PCB 412 that extends in a downstream direction beyond the cartridge wall 468 into the explosive portion 403 when the explosive portion 403 and the non-explosive portion 402 are assembled.

The PCB mounted resistor 404 is mounted directly to a PCB 412 that interfaces with a power cartridge 416 when assembled. The PCB 412 may be held by one or more ribs 447 within the cartridge 448. As clearly shown in FIG. 12, in some embodiments, the cartridge 448 is formed from the first cartridge half 449 and the second cartridge half 451. The first cartridge half 449 and the second cartridge half 451 snap or fit together to form the cartridge 448, with the cartridge cavity 453 inside of cartridge 448. The pressure bulk head 432 is partially disposed within the cartridge cavity 453. The cartridge 448 and the pressure bulkhead 432 assembly fits at least partially into the interior portion 485 of a pressure block 436. (see, e.g. FIG. 3).

The PCB 412 is used like a key that slides into an adapter or slot 420 on the power cartridge 416 and that holds or is adjacent to the ignition material, or energetic material 424. The PCB mounted resistor 404, is used to ignite the energetic material 424. In this illustrative embodiment, the PCB mounted resistor 404 is not embedded in the energetic material 424 but is adjacent to the energetic material 424. In some embodiments, the PCB mounted resistor 404 is outside the tubular 476 of the power cartridge, or power charge 416 (see also 196 in FIG. 3). In some embodiments, other heating elements 408 may be used on an elongated member that inserts into the slot 420. The heating element 408 may be a resistor, heating coil, bus wire, or other electrical device to provide sufficient energy to initiate the energetic material 424.

Note that this arrangement, i.e. the separation of the ignitor and the power cartridge 416 from each other, allows the power cartridge or charge 416 to be reverse or backward compatible with other igniter assemblies. The power cartridge or charge 416 could be used in a standard setting tool adjacent and ignited with a traditional igniter. In the alternative, existing setting tools may be fitted with the PCB 412 based igniter, such as an igniter with a PCB mounted resistor 404, as described herein, and that is used to ignite the power charge 480. Also, an important advantage is that the PCB 412 based igniter may be shipped and handled as a non-hazardous material since all of the incendiary or explosive material has been removed.

While many features of the igniter assembly 400 of FIGS. 11-14 are analogous to the embodiment of FIG. 3, some differences and aspects are highlighted here. An electrical contact 428 is where the electrical signals are received from the surface (e.g. from the control interface 136 on the surface 140 of FIG. 1) and into the setting tool 120 for control of the PCB 412 and subsequently the heating element 408. The signal goes through the pressure bulkhead 432 in the pressure block 436 at an upstream (or first end) of the setting tool 120. The main purpose of the pressure bulkhead 432 is to retain the gas pressure created by the power charge 480 from the right-hand side (for the orientation shown) and keep the gases from escaping in an uphole direction.

A lead package 440 (FIG. 11), which is mounted into the downhole side of the pressure bulkhead 432, is where the electrical signal comes out of the pressure bulkhead 432. A wire 455 or other electrical conductor is coupled onto a lead package 440, typically proximate a distal end 444 of the lead package 440. The wire 455 is further coupled to the PCB 412 by a connector 452 to supply electrical power to the PCB 412. At the time of ignition, the circuitry of the PCB 412 routes the electrical current to the electrical heating element 408, e.g., resistor 404, which is mounted onto the PCB 412. The electrical heating element 408 is activated by application of an electrical current by an electrical power source and the electrical current flows from the electrical power source, to the printed circuit board 412, and to the electrical heating element 408. A second wire connects to PCB 412. This second wire connects from the opposite side of the resistor 404 to the pressure block 436 or other suitable grounded component.

In other embodiments, the ignition may be controlled by an addressable switch, which is a well known component in the art. The signal goes to the PCB 412 at a connector 452. In these embodiments, the electrical power from the lead package 440 is routed by the wire 455 to an addressable switch, or to the PCB 412 or elsewhere—even outside the cartridge 448 on some embodiments. The addressable switch is then electrically connected to the PCB 412 with the connector 452. The addressable switch is controlled from the surface and can be selectively activated by an operator. As in the other above described embodiments, the circuitry of the PCB 412 provides an electrical connection to the resistor 404, and when the resistor 404 is energized by the electrical current the resistor 404 heats up, catches fire, or flares off. This energy release by the resistor 404 transfers to the energetic material 424, and ignites the energetic material 424. In embodiments that include an addressable switch, the electrical heating element 408 is activated by application of an electrical current by an electrical power source and the electrical current flows from the electrical power source, to the addressable switch, to the printed circuit board 412, and to the electrical heating element 408.

In other embodiments, in which the igniter is controlled by an addressable switch, the internal electrical connections may be made as described above in relation to the PCB based igniter without an addressable switch, and the addressable switch may be located outside of the cartridge 448 or setting tool 120. In these embodiments, the addressable switch is included in the electrical current pathway between the surface and the electrical contact 428. By this arrangement, the addressable switch can be used to determine when the electrical contact 428, and ultimately the PCB mounted resistor 404 or heating element 408, will be supplied with electrical current to initiate the ignition process.

Use of an igniter with an addressable switch, as described herein, may help ensure compliance with API RP 67 Recommended Practice for Oilfield Explosives Safety.

Figure 11:
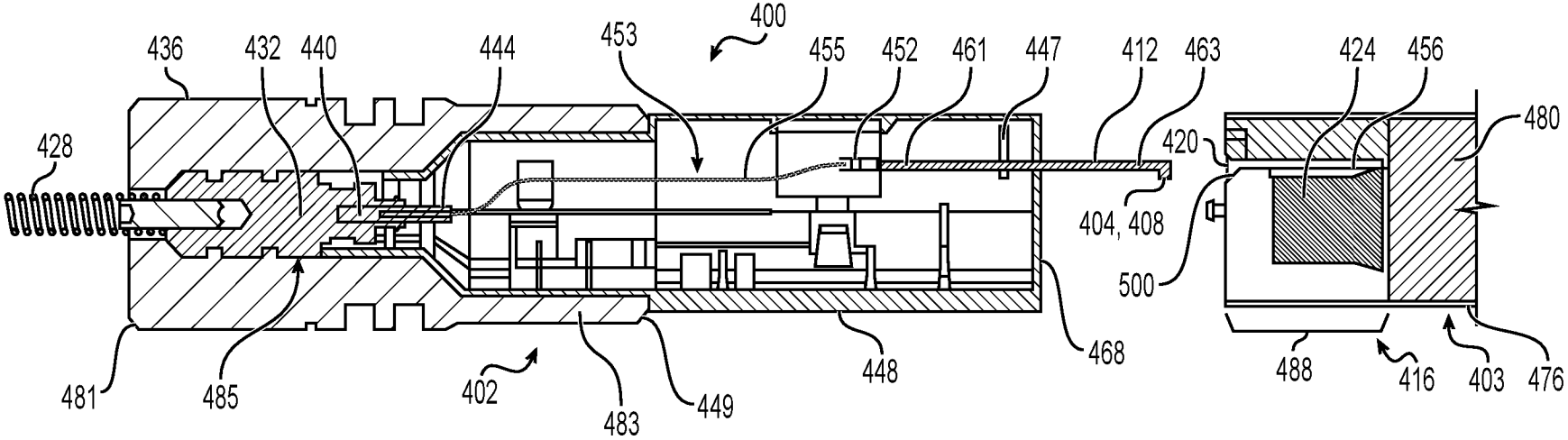
FIG. 11 is a schematic, partially exploded cross section of an igniter assembly according to an illustrative embodiment.
Figure 14:
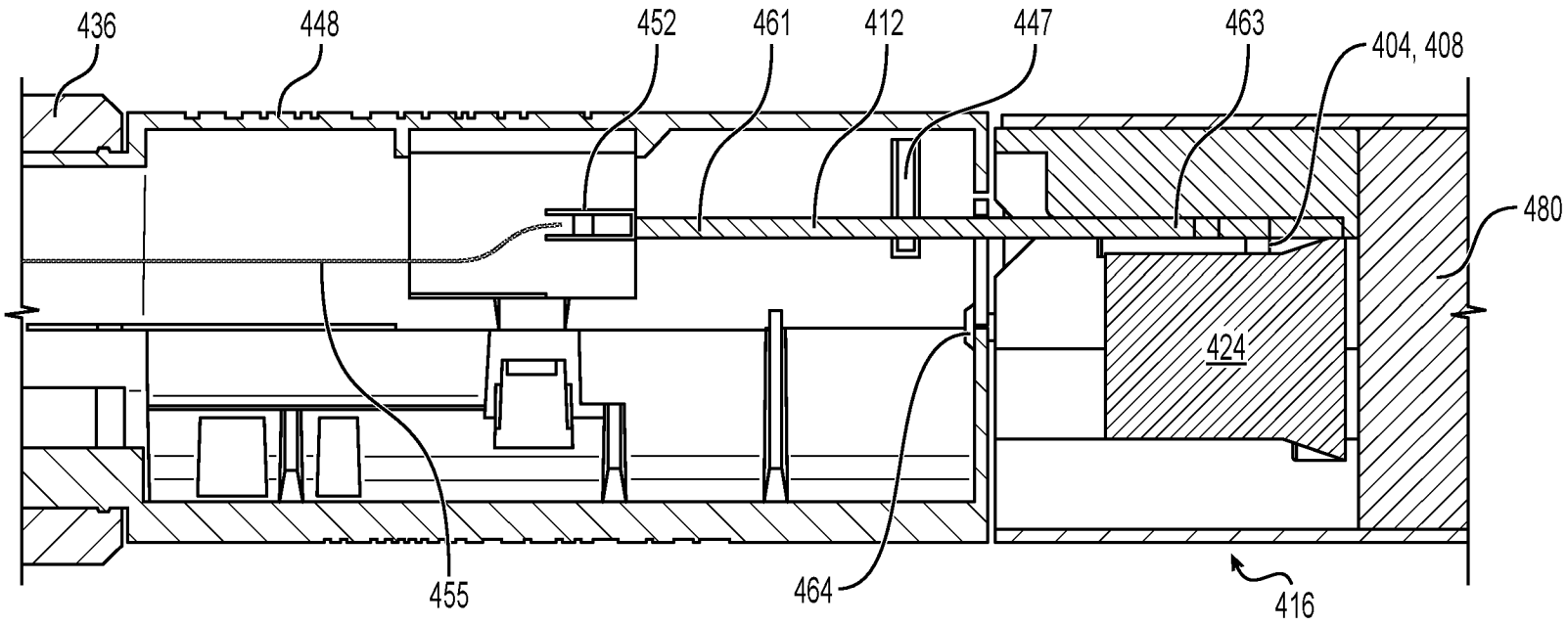
FIG. 14 is a schematic, cross section of a portion of an igniter assembly according to an illustrative embodiment in an assembled position.

Turning now to the right part (for the orientation shown) of FIG. 11, when assembling the ignition assembly 400 with respect to the power charge 416, the PCB 412 slides into the slot 420. The PCB 412 goes at least partially into a channel 456 with the electrical heating element 408, e.g., PCB mounted resistor 404, coming to a position adjacent to the energetic material 424. The assembled position is shown in FIG. 14. In other embodiments, in place of PCB 412, a rod with a heating element, such as a resistor or heating coil may be inserted into channel 456 with the same effect.

Figure 12:
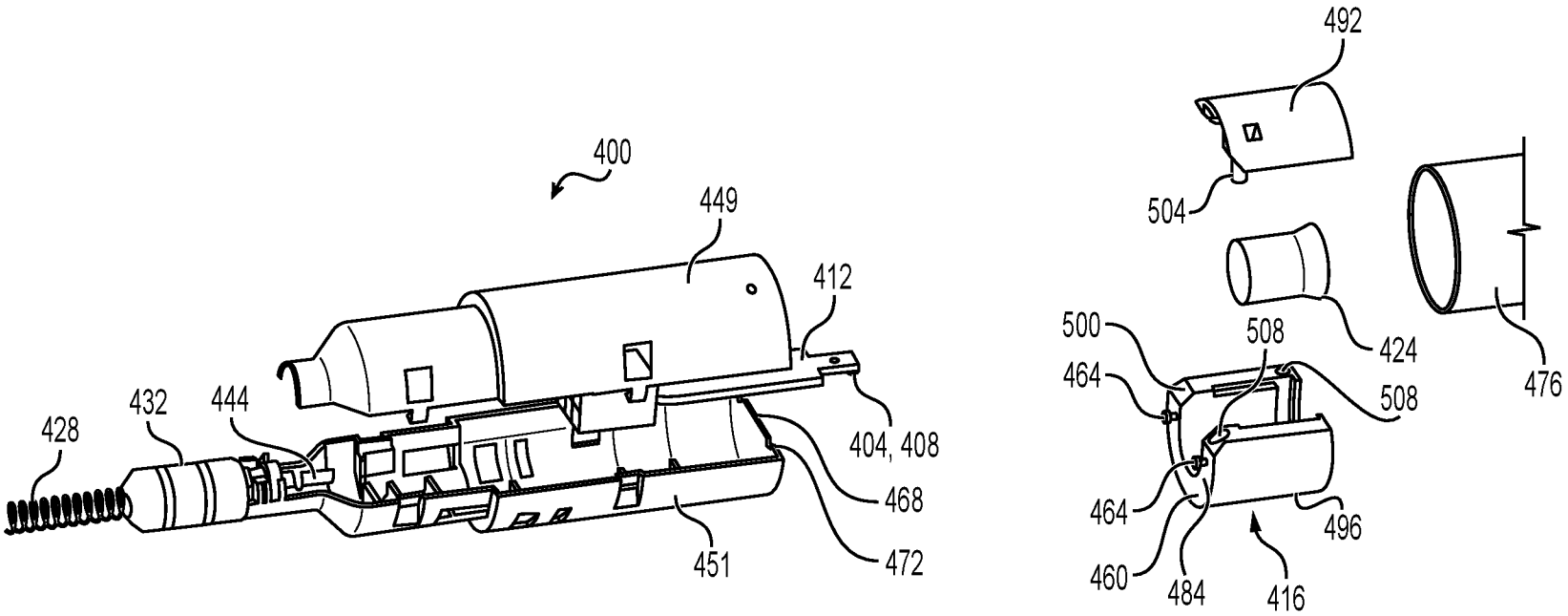
FIG. 12 is a schematic, partially exploded view of the igniter assembly of FIG. 11 without the pressure block.
Figure 13:
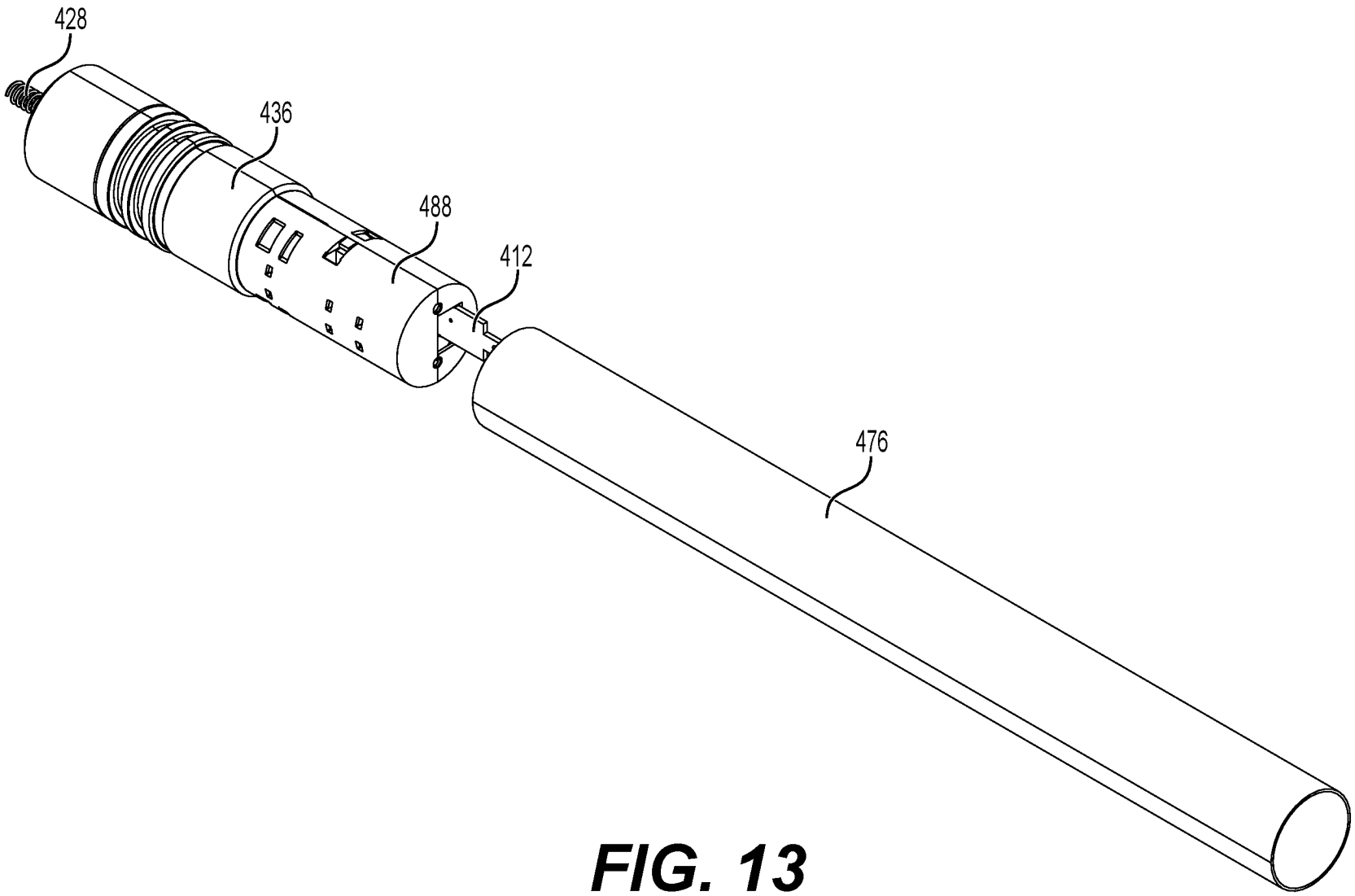
FIG. 13 is a schematic, partially exploded view of an igniter assembly according to an illustrative embodiment.

As clearly shown in FIG. 12, the power cartridge 416 may have an upstream wall 460 that includes one or more mechanical retention features 464 that interface and couple with a downstream wall 468 on the cartridge 448. The coupling may occur in many ways as one skilled in the art will appreciate. In this embodiment, the retention features 464 may snap into apertures 472 or channel openings (see FIG. 12) formed on the downstream wall 468. The retention features 464 have a flange head that deforms to go through the apertures 472 before being restored to a normal position that will then not go back through the apertures 472, thereby locking the power cartridge 416 to other aspects of the igniter assembly 400. This arrangement avoids any rotation or any movement, and the power cartridge 416 is held in position.

FIG. 14 shows the energetic material 424 (204 in earlier figures) only partially filling a chamber 494 formed by first portion 492 and a second portion 496, but in other embodiments, the energetic material 424 fills the resultant chamber 494 to the upstream edge. In some embodiments, the upstream edge has a solid wall except for slot 420 (FIG. 11). In some embodiments, the front portion of the chamber 494 is solid (wall), a void, or an aperture. The void being used for backward compatible models.

In some embodiments, the explosive portion 403 may include the cardboard tube or other tube 476. The tube 476 has a main propellant, or power charge 480, within an interior. The power cartridge 416 is also disposed with the tube and holds the energetic material 242. In this arrangement, the energetic material 424 is adjacent to the power charge 480. In some embodiments, the power cartridge 416 is a removable component of the explosive portion 403 and may be inserted into the tube 476 when an operator is ready to use the ignitor assembly 400.

At an upstream end 484 of the power cartridge 416 is a power cartridge body 488 forming the chamber 494. The power cartridge body 488 may include the first portion 492 and the second portion 496 that combine to form the chamber 494, which holds the energetic material 424. The power cartridge body 488, containing the energetic material 242, is inserted into the tube 476 adjacent to the power charge 480. One or more mating posts 504 (FIG. 12) may be included to facilitate coupling by mating with a matching aperture, e.g., aperture or cavity 508 (FIG. 12) in the other portion.

The slot 420 may be formed with chamfered or angled surfaces 500 for assistance with the introduction of the PCB 412.

Referring now primarily to FIG. 12, the apertures 508 that would mate with posts, e.g., post 504, are shown clearly. Also, features may be included to allow other designs with the same components. For example, a channel 512 may be included to allow for a through hole resistor to be used. In such an embodiment, a through hole resistor inserts into the second portion 496 and then is externally connected (see, e.g., FIGS. 3 and 5). If that version is used, with the through hole resistor, the resistor (not shown) inserts into the channel 512 and the resistor would be on the downstream face of the energetic material 424 (see, e.g., FIG. 4). The void space 516 (FIG. 14) may be used for leads to and from the resistor. The resistor body could also be placed in the channel 512, as long as it is adjacent to the secondary pellet.

As used herein, "adjacent" means close enough for the resistor to ignite the energetic material 424 when energized.

The embodiments of FIGS. 11-14 may present a number of advantages, and some of the possible advantages are mentioned here. In one aspect, the embodiments herein may be less expensive to build than other designs and may be more reliable. There is also ease and savings in eliminating the need for a traditional igniter. Moreover, the backwards compatibility of some of designs is a feature allowing improvements without overly expanding the stocking of designs. Further still, shipping the cartridge (e.g., 448) is not hazardous material.

There are a number of examples of the present disclosure. Some additional examples follow.

Example 1. An igniter assembly for use with a gas-powered setting tool, the igniter assembly comprising:

a pressure block having a first end, a second end, and an interior portion;

a pressure bulkhead sized and configured to couple to a portion of the pressure block in the interior portion of the pressure block;

an insulator cap sized and configured to couple to the second end of the pressure block;

a power charge within a combustion chamber adjacent to the pressure block and having a first end and as second end, wherein the first end of the power charge abuts the insulator cap, and wherein the power charge has an energetic material at the first end and a main propellant adjacent thereto; and wherein the insulator cap further comprises:

an insulator cap body having an exterior surface, an electrical heating element positioned on the exterior surface of the insulator cap and disposed adjacent to the energetic material of the power charge when in an assembled position, wherein the electrical heating element has a first lead and a second lead, a tension spring coupled to the insulator cap body and biasing the electrical heating element toward the energetic material when in the assembled position, a conduction plate coupled to the insulator cap body for receiving electrical energy through a transfer spring that abuts the conduction plate or is coupled to the conduction plate in an assembled position, and wherein the conduction plate is electrically coupled to the first or second lead of the electrical heating element.

Example 2. An igniter assembly for use with a gas-powered setting tool, the igniter assembly comprising:

a pressure block having a first end, a second end, and an interior portion;

a pressure bulkhead sized and configured to secure to a portion of the pressure block in the interior portion of the pressure block;

an insulator cap sized and configured to couple to the second end of the pressure block;

a power charge within a container within a combustion chamber adjacent to the pressure block and having a first end and as second end;

wherein the first end of the power charge abuts the insulator cap, and wherein the power charge has an energetic material at the first end and a main propellant adjacent to the energetic material, and wherein the container has a first end and a second end;

a power charge end cap having a first side and second side for covering the first end of the container of the power charge and disposed adjacent to the pressure block when in an assembled position;

an electrical heating element disposed in an interior of the container of the power charge adjacent to the energetic material, wherein the electrical heating element has a first lead and a second lead;

wherein the power charge end cap has a first electrical interface forming a first contact on the first side of the power charge end cap and wherein the first lead of the electrical heating element is electrically coupled to the first contact; and wherein the insulator cap further comprises:

an insulator cap body, a first electrical contact biased outward toward the power charge end cap and sized and configured to contact the first electrical interface of the power charge end cap when in an assembled position, and a conduction plate coupled to the insulator cap body for receiving electrical energy through a transfer spring that abuts the conduction plate or is coupled to the conduction plate in an assembled position, and wherein the conduction plate is electrically coupled to the first electrical contact.

Example 3. The igniter assembly of Example 2, wherein the power charge end cap has a second electrical interface forming a second contact on the first side of the power charge end cap and wherein the second lead of the electrical heating element is electrically coupled to the second contact; and wherein the insulator cap further comprises a second electrical contact biased outward toward the power charge end cap and sized and configured to make contact with the second electrical interface of the power charge end cap when in an assembled position.

Example 4. An igniter assembly for use as an aspect of a gas-powered setting tool, the igniter assembly comprising:

a non-explosive portion having a printed circuit board with a resistor coupled thereto;

an explosive portion having an energetic material and a power charge material;

wherein the explosive portion is formed with a slot sized and configured to receive at least a portion of the printed circuit board with the resistor; and wherein in an assembled position the explosive portion is coupled to the non-explosive portion with the printed circuit board at least partially within the slot and the resistor adjacent to the energetic material in the explosive portion.

Example 5. The igniter assembly of Example 3, wherein:

the non-explosive portion comprises:

a pressure block having a first end, a second end, and an interior portion, a pressure bulkhead sized and configured to couple to a portion of the pressure block in the interior portion of the pressure block, a cartridge coupled at an upstream end of the cartridge to the pressure bulkhead and having a cartridge wall on a downstream edge and having an interior chamber, and the printed circuit board having a distal end, wherein the distal end of the printed circuit board extends in a downstream direction beyond the cartridge wall; and the explosive portion comprises:

a power cartridge body having an interior chamber housing the energetic material and the power charge material, and the power cartridge body formed with the slot.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. An igniter assembly for use as an aspect of a setting tool, the igniter assembly comprising:

a non-explosive portion having a non-explosive portion housing;

a printed circuit board at least partially disposed within the non-explosive portion housing;

an electrical heating element coupled to the printed circuit board;

wherein the printed circuit board is electrically coupled to the electrical heating element;

wherein the printed circuit board is electrically coupled to an electrical power source;

an explosive portion having an explosive portion housing;

an energetic material disposed within the explosive portion housing;

wherein the explosive portion is formed with a slot sized and configured to receive a portion of the printed circuit board;

wherein in an assembled position, the explosive portion housing is coupled to the non-explosive portion housing with the printed circuit board partially within the slot and with the electrical heating element adjacent to the energetic material in the explosive portion;

wherein the electrical heating element is activated by application of an electrical current by the electrical power source and the electrical current flows from the electrical power source, to the printed circuit board, and to the electrical heating element; and wherein the non-explosive portion housing and the explosive portion housing are separable from each other.

2. The igniter assembly of claim 1, wherein:

the non-explosive portion comprises:

a pressure block having a first end, a second end, and an interior portion, a pressure bulkhead sized and configured to couple to a portion of the pressure block within the interior portion of the pressure block, wherein the non-explosive portion housing comprises a cartridge coupled at an upstream end of the cartridge to the pressure bulkhead and having a cartridge wall on a downstream edge and having an interior chamber, and wherein, the printed circuit board has a proximate end and a distal end, wherein, when the explosive portion and the non-explosive portion are assembled, the distal end of the printed circuit board extends in a downstream direction beyond the cartridge wall and the proximate end is disposed within the interior chamber of the cartridge; and wherein the explosive portion housing is formed with the slot.

3. The igniter assembly of claim 2, wherein the electrical heating element is a resistor.

4. The igniter assembly of claim 2, wherein, the explosive portion further comprises a power cartridge;

wherein the power cartridge further comprises a tube with a power charge material disposed with the tube; and wherein the energetic material is disposed within the tube.

5. The igniter assembly of claim 1, wherein the electrical heating element is a resistor.

6. The igniter assembly of claim 1, wherein the explosive portion further comprises a power cartridge, wherein the energetic material is disposed within the power cartridge and the energetic material is adjacent to a power charge material.

7. The igniter assembly of claim 6, wherein the power cartridge comprises a tube and the power charge material and the energetic material are disposed within the tube.

8. The igniter assembly of claim 1, wherein the non-explosive portion further comprises an addressable switch, where in the addressable switch is disposed within the non-explosive portion housing and is electrically coupled to the power source and is electrically coupled to the printed circuit board, and wherein the electrical heating element is activated by application of an electrical current by the electrical power source and the electrical current flows from the electrical power source, to the addressable switch, to the printed circuit board, and to the electrical heating element.

9. The igniter assembly of claim 1, wherein, the electrical heating element is a resistor;

wherein, the explosive portion further comprises a power cartridge comprising a tube with a power charge material disposed within the tube; and wherein, the energetic material is disposed within the tube and the the energetic material is adjacent to the power charge material.

10. The igniter assembly of claim 9, wherein the non-explosive portion further comprises an addressable switch, where in the addressable switch is disposed within the non-explosive portion housing and is electrically coupled to the power source and is electrically coupled to the printed circuit board, and wherein the electrical heating element is activated by application of an electrical current by the electrical power source and the electrical current flows from the electrical power source, to the addressable switch, to the printed circuit board, and to the electrical heating element.

* * * * *